US008056652B2

(12) United States Patent
Lockwood et al.

(10) Patent No.: US 8,056,652 B2
(45) Date of Patent: Nov. 15, 2011

(54) BARRIER COATED GRANULES FOR IMPROVED HARDFACING MATERIAL USING ATOMIC LAYER DEPOSITION

(75) Inventors: Gregory T. Lockwood, Pearland, TX (US); Guodong Zhan, Spring, TX (US)

(73) Assignee: Smith International, Inc., Houston, TX (US)

( * ) Notice: Subject to any disclaimer, the term of this patent is extended or adjusted under 35 U.S.C. 154(b) by 240 days.

(21) Appl. No.: 12/133,918

(22) Filed: Jun. 5, 2008

(65) Prior Publication Data

US 2008/0314646 A1 Dec. 25, 2008

Related U.S. Application Data

(60) Provisional application No. 60/946,044, filed on Jun. 25, 2007.

(51) Int. Cl.
*E21B 10/36* (2006.01)

(52) U.S. Cl. ..... 175/425; 175/331

(58) Field of Classification Search ..... 175/425, 175/434, 331; 27/232, 235, 236, 240, 242, 27/243

See application file for complete search history.

(56) References Cited

U.S. PATENT DOCUMENTS 3,379,503 A 4/1968 McKenna
3,650,714 A * 3/1972 Farkas ..... 51/295
3,663,191 A * 5/1972 Kroder ..... 428/643
4,723,996 A 2/1988 Brunet et al.
4,834,963 A 5/1989 Terry et al.
4,960,643 A * 10/1990 Lemelson ..... 428/408
5,089,182 A 2/1992 Findeisen et al.
5,541,006 A 7/1996 Conley
5,997,248 A * 12/1999 Ghasripoor et al. ..... 415/173.4
6,138,779 A 10/2000 Boyce
6,287,360 B1 9/2001 Kembaiyan et al.
6,372,012 B1 4/2002 Majagi et al.
6,469,278 B1 * 10/2002 Boyce ..... 219/146.1
6,613,383 B1 9/2003 George et al.
6,908,688 B1 6/2005 Majagi et al.
6,913,827 B2 * 7/2005 George et al. ..... 428/402
2003/0024351 A1 * 2/2003 Pender et al. ..... 75/243
2004/0105980 A1 * 6/2004 Sudarshan et al. ..... 428/404
2005/0109545 A1 5/2005 Lockwood et al.
2008/0073127 A1 * 3/2008 Zhan et al. ..... 175/434

OTHER PUBLICATIONS

J. R. Wank et al. Nanocoating individual cohesive boron nitride particles in a fluidized bed by ALD; Powder Technology 142, pp. 59-69 (2004).

* cited by examiner

*Primary Examiner* — David Bagnell
*Assistant Examiner* — Cathleen Hutchins
(74) *Attorney, Agent, or Firm* — Osha Liang LLP

(57) ABSTRACT

A hardfacing composition for a drill bit that includes an abrasive phase comprising a plurality of abrasive particles having a barrier coating deposited by atomic layer deposition disposed thereon; and a binder alloy is disclosed. Drill bits having hardfacing compositions that include an abrasive phase comprising a plurality of abrasive particles having a barrier coating deposited by atomic layer deposition disposed thereon; and a binder alloy are also disclosed.

13 Claims, 4 Drawing Sheets

12 1/4 FGXi, #5C10,32X

S/n MJ9314, 12 1/4 FGXi
#5C10, 32X

BARRIER COATED GRANULES FOR IMPROVED HARDFACING MATERIAL USING ATOMIC LAYER DEPOSITION

CROSS-REFERENCE TO RELATED APPLICATIONS

This application, pursuant to 35 U.S.C. §119(e), claims priority to U.S. Patent Application No. 60/946,044, filed on Jun. 25, 2007, which is herein incorporated by reference in its entirety.

BACKGROUND OF INVENTION

1. Field of the Invention

Embodiments disclosed herein relate generally to techniques and compositions which provide improved hardfacing materials.

2. Background Art

Historically, there have been two types of drill bits used drilling earth formations, drag bits and roller cone bits. Roller cone bits include one or more roller cones rotatably mounted to the bit body. These roller cones have a plurality of cutting elements attached thereto that crush, gouge, and scrape rock at the bottom of a hole being drilled. Several types of roller cone drill bits are available for drilling wellbores through earth formations, including insert bits (e.g. tungsten carbide insert bit, TCI) and "milled tooth" bits. The bit bodies and roller cones of roller cone bits are conventionally made of steel. In a milled tooth bit, the cutting elements or teeth are steel and conventionally integrally formed with the cone. In an insert or TCI bit, the cutting elements or inserts are conventionally formed from tungsten carbide, and may optionally include a diamond enhanced tip thereon.

The term "drag bits" refers to those rotary drill bits with no moving elements. Drag bits are often used to drill a variety of rock formations. Drag bits include those having cutting elements or cutters attached to the bit body, which may be a steel bit body or a matrix bit body formed from a matrix material such as tungsten carbide surrounded by an binder material. The cutters may be formed having a substrate or support stud made of carbide, for example tungsten carbide, and an ultra hard cutting surface layer or "table" made of a polycrystalline diamond material or a polycrystalline boron nitride material deposited onto or otherwise bonded to the substrate at an interface surface.

Typically, a hardfacing material is applied, such as by arc or gas welding, to the exterior surface of the steel components (e.g., milled teeth or steel bit body) to improve the wear resistance of the area of the bit. The hardfacing material typically includes one or more metal carbides, which are bonded to the steel teeth by a metal alloy ("binder alloy"). In effect, the carbide particles are suspended in a matrix of metal forming a layer on the surface of the teeth. The carbide particles give the hardfacing material hardness and wear resistance, while the matrix metal provides fracture toughness to the hardfacing.

Many factors affect the durability of a hardfacing composition in a particular application. These factors include the chemical composition and physical structure (size and shape) of the carbides, the chemical composition and microstructure of the matrix metal or alloy, and the relative proportions of the carbide materials to one another and to the matrix metal or alloy. The metal carbide most commonly used in hardfacing is tungsten carbide. Small amounts of tantalum carbide and titanium carbide may also be present in such material, although these other carbides may be considered to be deleterious.

Many different types of tungsten carbides are known based on their different chemical compositions and physical structure. Three types of tungsten carbide commonly typically used in hardfacing drill bits are cast tungsten carbide, macro-crystalline tungsten carbide, and cemented tungsten carbide (also known as sintered tungsten carbide).

Cemented tungsten carbide refers to a material formed by mixing particles of tungsten carbide, typically monotungsten carbide, and particles of cobalt or other iron group metal, and sintering the mixture. In a typical process for making cemented tungsten carbide, small tungsten carbide particles, e.g., 1-15 microns, and cobalt particles are vigorously mixed with a small amount of organic wax which serves as a temporary binder. An organic solvent may be used to promote uniform mixing. The mixture may be prepared for sintering by either of two techniques: it may be pressed into solid bodies often referred to as green compacts; alternatively, it may be formed into granules or particles such as by pressing through a screen, or tumbling and then screened to obtain more or less uniform particle size.

Such green compacts or particles are then heated in a vacuum furnace to first evaporate the wax and then to a temperature near the melting point of cobalt (or the like) to cause the tungsten carbide particles to be bonded together by the metallic phase. After sintering, the compacts are crushed and screened for the desired particle size. Similarly, the sintered particles, which tend to bond together during sintering, are gently churned in a ball mill with media to separate them without damaging the particles. Some particles may be crushed to break them apart. These are also screened to obtain a desired particle size. The crushed cemented carbide is generally more angular than the particles which tend to be rounded.

Another type of tungsten carbide is macro-crystalline carbide. This material is essentially stoichiometric tungsten carbide created by a thermite process. Most of the macro-crystalline tungsten carbide is in the form of single crystals, but some bicrystals of tungsten carbide may also form in larger particles. Single crystal stoichiometric tungsten carbide is commercially available from Kennametal, Inc., Fallon, Nev.

Carburized carbide is yet another type of tungsten carbide. Carburized tungsten carbide is a product of the solid-state diffusion of carbon into tungsten metal at high temperatures in a protective atmosphere. Sometimes, it is referred to as fully carburized tungsten carbide. Such carburized tungsten carbide grains usually are multi-crystalline, i.e., they are composed of tungsten carbide agglomerates. The agglomerates form grains that are larger than the individual tungsten carbide crystals. These large grains make it possible for a metal infiltrant or an infiltration binder to infiltrate a powder of such large grains. On the other hand, fine grain powders, e.g., grains less than 5 μm, do not infiltrate satisfactorily. Typical carburized tungsten carbide contains a minimum of 99.8% by weight of tungsten carbide, with a total carbon content in the range of about 6.08% to about 6.18% by weight.

Regardless of the type of hardfacing material used, designers continue to seek improved properties (such as improved wear resistance, thermal resistance, etc.) in the hardfacing materials. Unfortunately, increasing wear resistance usually results in a loss in toughness, or vice-versa. One suggested technique has been to apply a "coating" layer around a hardfacing granule. A coating on the ceramic particles or particles of other hard materials may be formed from materials and alloys such as tungsten carbide, and tungsten carbide/cobalt and cermets such as metal carbides and metal nitrides. The coated particles are typically pre-mixed with selected materials such that welding and cooling will form both metallurgical bonds and mechanical bonds within the solidified matrix deposit.

A welding rod may be prepared by placing a mixture of selected hard particles such as coated cubic boron nitride particles, hard particles such as tungsten carbide/cobalt, and loose filler material into a steel tube. A substrate may be hardfaced by progressively melting the welding rod onto a selected surface of the substrate and allowing the melted material to solidify and form the desired hardfacing with coated cubic boron nitride particles dispersed within the matrix deposit on the substrate surface.

U.S. Pat. No. 6,138,779 (the '779 patent) discloses a technique of coating cubic boron nitride particles with tungsten carbide particles or a ceramic to provide a thermal barrier to prevent thermal degradation of the particle into a reduced wear resistant phase. In particular, the '779 patent discloses a hardfacing composition to protect wear surfaces of drill bits and other downhole tools that consists of cubic boron nitride particles or of other ceramic, superabrasive or superhard materials coated with a thickness of approximately one half the diameter of the coated particles, where the coated particles are dispersed within and bonded to a matrix deposit.

Other coated particles include those coated with chemical vapor deposition (CVD), such as those disclosed in U.S. Pat. No. 6,372,012, which typically have coatings on the micrometer scale in thickness.

However, while these coating may improve some properties, these hardfacing compositions may have service limitations for various reasons. For example, too thick of a coating will reduce the volume fraction of the abrasive, therefore reducing the overall wear resistance of the hardfacing. Additionally, particles coated with CVD coatings, while thinner in nature, may require high temperatures for deposition and the coatings, in particular, the thickness of the coating may be difficult to control.

Accordingly, there exists a continuing need for improvements in hardfacing materials.

SUMMARY OF INVENTION

In one aspect, embodiments disclosed herein relate to a hardfacing composition for a drill bit that includes an abrasive phase comprising a plurality of abrasive particles having a barrier coating deposited by atomic layer deposition disposed thereon; and a binder alloy.

In another aspect, embodiments disclosed herein relate to a roller cone drill bit, that includes a bit body; at least one roller cone rotatably mounted to the bit body; and at least one cutting element on the at least one roller cone, wherein an exterior surface of the at least one cutting element comprises a hardfacing thereon, the hardfacing comprising: an abrasive phase comprising a plurality of abrasive particles having a barrier coating deposited by atomic layer deposition disposed thereon; and a binder alloy.

In yet another aspect, embodiments disclosed herein relate to a drill bit that includes a bit body having at least one blade thereon; at least one cutter pocket disposed on the blade; at least one cutter disposed in the cutter pocket; and hardfacing applied to at least a select portion of the drill bit, the hardfacing comprising: an abrasive phase comprising: a plurality of abrasive particles having a barrier coating deposited by atomic layer deposition disposed thereon; and a binder alloy.

Other aspects and advantages of the invention will be apparent from the following description and the appended claims.

DETAILED DESCRIPTION

Embodiments of the present disclosure relate to providing a "diffusion barrier coating" onto the surface of hardfacing granules. Particular embodiments relate to providing a barrier coating via atomic layer deposition onto abrasive particles, such as tungsten carbide particles, to form "coated particles."

Figure 1:
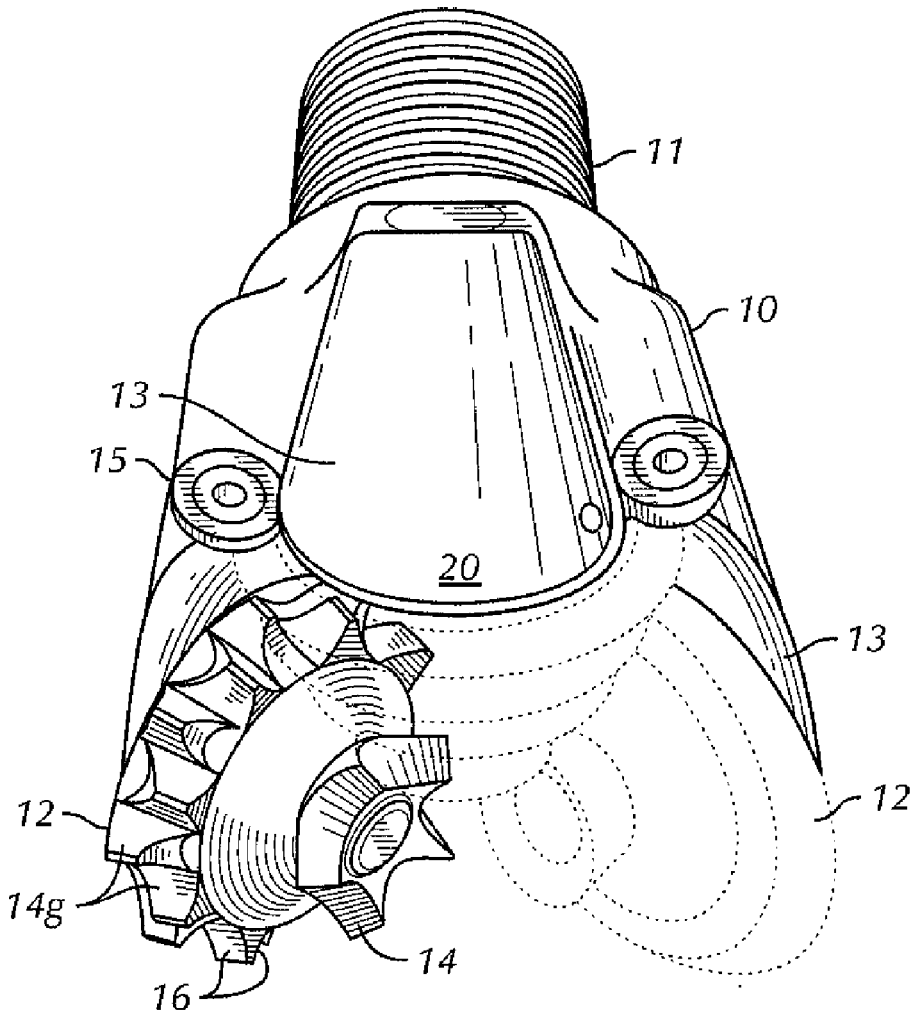
FIG. 1 shows a milled tooth roller cone rock bit in accordance with the present disclosure.

Referring to FIG. 1, an example of a milled tooth roller cone drill bit is shown. As shown, the bit includes a steel body 10 having a threaded coupling ("pin") 11 at one end for connection to a conventional drill string (not shown). At the opposite end of the drill bit body 10 are three roller cones 12, for drilling earth formations. Each of the roller cones 12 is rotatably mounted on a journal pin (not shown in FIG. 1) extending diagonally inwardly on each one of the three legs 13 extending downwardly from the bit body 10. As the bit is rotated by the drill string (not shown) to which it is attached, the roller cones 12 effectively roll on the bottom of the wellbore being drilled. The roller cones 12 are shaped and mounted so that as they roll, teeth 14 on the cones 12 gouge, chip, crush, abrade, and/or erode the earth formations (not shown) at the bottom of the wellbore. The teeth 14G in the row around the heel of the cone 12 are referred to as the "gage row" teeth. They engage the bottom of the hole being drilled near its perimeter or "gage." Fluid nozzles 15 direct drilling fluid ("mud") into the hole to carry away the particles of formation created by the drilling.

Such a roller cone rock bit as shown in FIG. 1 is conventional and is therefore merely one example of various arrangements that may be used in a rock bit in accordance with the present disclosure. For example, most roller cone rock bits have three roller cones as illustrated in FIG. 1. However, one, two and four roller cone drill bits are also known in the art. Therefore, the number of such roller cones on a drill bit is not intended to be a limitation on the scope of the invention. In addition, embodiments of the present disclosure apply equally well to drag bits.

The arrangement of the teeth 14 on the cones 12 shown in FIG. 1 is just one of many possible variations. In fact, it is typical that the teeth on the three cones on a rock bit differ from each other so that different portions of the bottom of the hole are engaged by each of the three roller cones so that collectively the entire bottom of the hole is drilled. A broad variety of tooth and cone geometries are known and do not form a specific part of this invention, nor should the invention be limited in scope by any such arrangement.

In addition, while embodiments of the present disclosure describe hardfacing teeth, embodiments of the present invention may be used to provide erosion protection for fixed cutter bits, or other types of bits or cutting tools as known in the art. The specific descriptions provided below do not limit the scope of the invention, but rather provide illustrative examples. Those having ordinary skill in the art will appreciate that the hardfacing compositions may be used on other types of and locations on drill bits and cutting tools.

Figure 2:
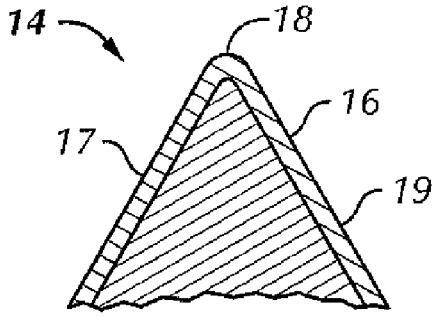
FIG. 2 shows a cross-section of a milled tooth in accordance with the present disclosure.

The example teeth on the roller cones shown in FIG. 1 are generally triangular in a cross-section taken in a radial plane of the cone. Referring to FIG. 2, such a tooth 14 has a leading flank 16 and a trailing flank 17 meeting in an elongated crest 18. The flank of the tooth 14 is covered with a hardfacing layer 19. Sometimes only the leading face of each such tooth 14 is covered with a hardfacing layer 19 so that differential erosion between the wear-resistant hardfacing on the front flank of a tooth and the less wear-resistant steel on the trailing face of the tooth may keep the crest of the tooth relatively sharp for enhanced penetration of the rock being drilled.

The leading flank 16 of the tooth 14 is the face that tends to bear against the undrilled rock as the rock bit is rotated in the wellbore. Because of the various cone angles of different teeth on a roller cone relative to the angle of the journal pin on which each cone is mounted, the leading flank on the teeth in one row on the same cone may face in the direction of rotation of the bit, whereas the leading flank on teeth in another row may on the same cone face away from the direction of rotation of the bit. In other cases, particularly near the axis of the bit, neither flank can be uniformly regarded as the leading flank, and both flanks may be provided with hardfacing. There are also times when the ends of a tooth, that is, the portions facing the more or less axial direction on the cone, are also provided with a layer of hardfacing. This is particularly true on the so-called gage surface of the bit which is often provided with hardfacing.

The gage surface is a generally conical surface at the heel of a cone which engages the side wall of a bole as the bit is used. The gage surface includes the outer end of teeth in the so-called gage row of teeth nearest the heel of the cone and may include additional area nearer the axis of the cone than the root between the teeth. The gage surface is not considered to include the leading and trailing flanks of the gage row teeth. The gage surface encounters the side wall of the hole in a complex scraping motion which induces wear of the gage surface. In some drill bits, hardfacing may also be applied on the shirttail (20 in FIG. 1) at the bottom of each leg on the bit body.

In various embodiments, coated particles are applied as a hardfacing as a filler in a steel tube. The hardfacing filler materials may further comprise deoxidizer and resin. When the coated particles are applied to drill bits, the coated particles may be dispersed in a matrix of alloy steel welded to the drill bits.

Figure 3A:
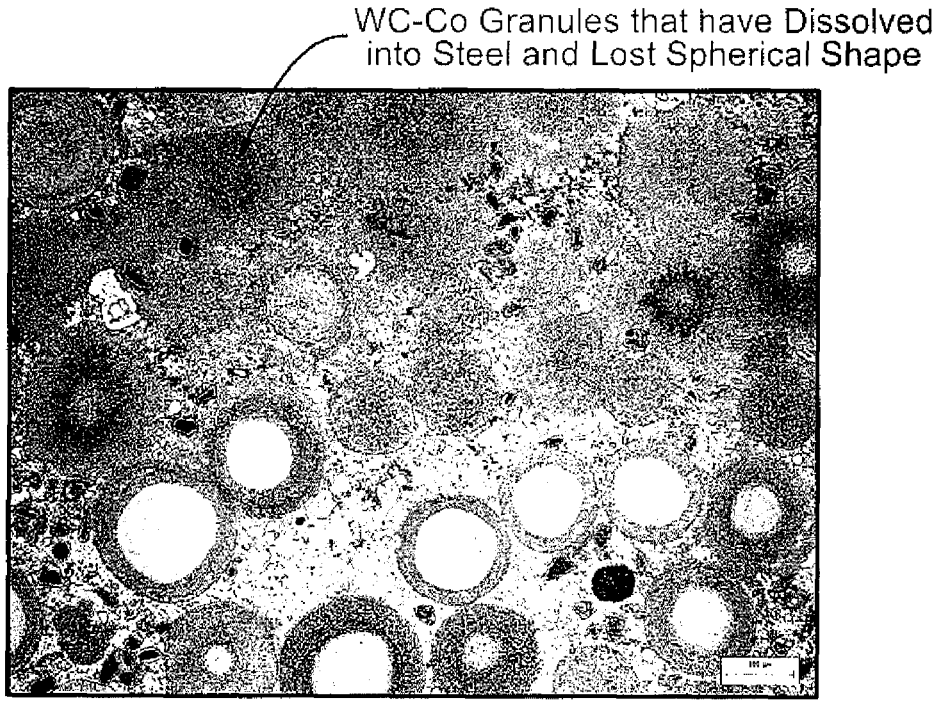
FIGS. 3A and 3B show prior art tungsten carbide-cobalt particles.
Figure 3B:
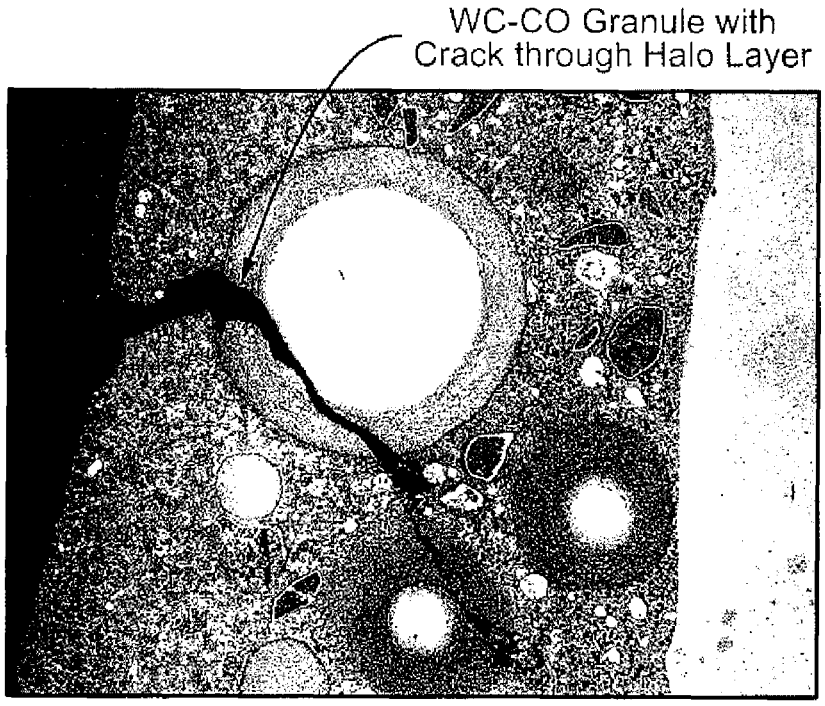

It is known, however, in conventional hardfacing that as the steel tube rod melts (during application of the hardfacing), cobalt from the tungsten carbide-cobalt granules diffuses into the weld pool, and steel from the "weld pool" diffuses into the granules. As discussed in U.S. Patent Publication No. 2005-0109545, which is assigned to the present assignee and incorporated by reference herein in its entirety, this has been quantified using quantitative EDS using a Jeol scanning electron microscope. A polish and chemical etch of the cross-section of the weld material as seen using an inverted light microscope, reveals a halo surrounding the granules (See FIGS. 3A and 3B). This halo results in a granule diameter that is 30% to 70% less than the starting diameter (before welding). Lab and field tests confirmed that this causes a significant drop in wear resistance and provides a relatively easy path for crack propagation through the brittle halo layer. These features are shown in FIGS. 3A and 3B. FIG. 3A illustrates tungsten carbide-cobalt particles that have dissolved into a surrounding steel matrix. This is partially evidenced by the loss of a spherical shape. FIG. 3B illustrates a tungsten carbide/cobalt particle having a crack running through the halo layer. A weld with thick halos surrounding the granules or with a high degree of loosely bound fine tungsten carbide particles reduces toughness. The reduced toughness, or crack propagation resistance, has severe consequences on a drill bit. Special design and welding techniques are needed for a sound weld of the crest 18 area of a tooth 14 (FIG. 2). The loss of toughness leads to premature chipping and breakage of the crest 18, reducing the life and rate of penetration of the drill bit. U.S. Patent Publication No. 2005-0109545 discloses improving toughness, as well as weldability, by providing a thin diffusion barrier ranging from 5 to 76 micrometers on its carbide particles while minimally affecting wear resistance due to the metal content.

By providing a very thin (nanolayer) diffusion coating on the abrasive particles, the resulting hardfacing composition may possess improved toughness and weldability without sacrificing wear resistance due a minimum metal content in the nanolayer. To minimize the metal content in the barrier coating, the inventors of the present disclosure have advantageously discovered that atomic layer deposition may be used to achieve a thin, conformal coating on the abrasive particles.

In a particular embodiment, abrasive particles used in a hardfacing composition may be provided with an ultra-thin, conformal coating thereon. As used herein, "ultra-thin" refers to a thickness of less than 500 nm. In a particular embodiment, the ultra-thin coating may have a thickness ranging from about 0.1 to about 100 nm, from about 0.5 to 50 nm in another embodiment, and from about 1 to 10 nm in yet another embodiment. "Conformal" refers to a relatively uniform thickness across the surface of the particle such that the surface shape of a coated particle closely resembles that of the uncoated particle.

In another embodiment, the abrasive particles of the present disclosure are provided with a conformal coating thereon, wherein the conformal coating comprises from about 0.1 to 5 volume percent of the coated abrasive particle. In a particular embodiment, the conformal coating comprises from about 0.5 to 3 volume percent of the volume of the coated abrasive particle.

Depending on the desired application of hardfacing and the type of abrasive particle to be coated, the composition of the coatings may vary. In a particle embodiment, the coating may include, for example, metals, metal alloys, ceramic materials, and cermets. For example, coatings that may be suitable for use on the hard phase particulate materials of the present disclosure may include metals and binary materials, i.e., materials of the form $Q_xR_y$, where Q and R represent different atoms and x and y are numbers that reflect an electrostatically neutral material. Among the suitable binary materials are various inorganic ceramic materials including oxides, nitrides, carbides, sulfides, fluorides, and combinations thereof. Examples of oxides that may find used in the present disclosure include those such as CoO, $Al_2O_3$, $TiO_2$, $Ta_2O_5$, $Nb_2O_5$, $ZrO_2$, $HfO_2$, $SnO_2$, ZnO, $La_2O_3$, $Y_2O_3$, $CeO_2$, $Sc_2O_3$, $Er_2O_3$, $V_2O_5$, $SiO_2$, $In_2O_3$, and the like. Examples of nitrides that may find use in the present disclosure include those such as $Si_3N_4$, AlN, TaN, NbN, TiN, MoN, ZrN, HfN, GaN, and the like. Examples of carbides that may find use in the present disclosure include those such as SiC, WC, and the like. Examples of sulfides that may find use in the present disclosure include those such as ZnS, SrS, CaS, PbS, and the like.

Examples of fluorides that may find use in the present disclosure include those such as $CaF_2$, $SrF_2$, $ZnF_2$, and the like. Among the suitable metal coatings include Pt, Ru, Ir, Pd, Cu, Fe, Co, Ni, W, and the like. Other types of materials that may be used to form an ultra-thin conformal coating include those described in U.S. Pat. No. 6,613,383, which is hereby incorporated by reference in its entirety. Coatings suitable for use in the present disclosure may also include mixed structures, such as TiAlN, Ti3AlN, ATO (AlTiO), coatings included doped metals, such as ZnO:Al, ZnS:Mn, SrS:Ce, $Al_2O_3$:Er, $ZrO_2$:Y, which may also include other rare earth metals ($Ce^{3+}$, $Tb^{3+}$, etc.) for doping or co-doping, or nanolaminates, such as $HfO_2/Ta_2O_5$, $TiO_2/Ta_2O_5$, $TiO_2/Al_2O_3$, $ZnS/Al_2O_3$, and the like.

In a particular embodiment, the ultra-thin, conformal coating of the present disclosure may be applied on the particulate materials through atomic layer controlled growth techniques or atomic layer deposition (ALD). ALD methods use self-limiting surface chemistry to control deposition. Under the appropriate conditions, deposition may be limited to a small number of functional groups on the surface, i.e., approximately one monolayer or $\sim 1\times10^{15}$ species per $cm^2$. ALD permits the deposition of coatings of up to about 0.3 nm in thickness per reaction cycle, and thus provide a means for controlling thickness to extremely fine thicknesses. In these techniques, the coating may be formed in a series of two or more self-limited reactions, which in most instances can be repeated to subsequently deposit additional layers of the coating material until a desired coating thickness is achieved. In most instances, the first of these reactions may involve some functional group on the surface of the particle, such as an M-H, M-O—H, or M-N—H group, where M represents an atom of a metal or semi-metal. The individual reactions may be carried out separately and under conditions such that all excess reagents and reaction products are removed before concluding the succeeding reaction. The particles may optionally be treated prior to initiating the reaction sequence to remove volatile materials that may have absorbed onto the surface of the particulate materials. This may be readily done by exposing the particles to elevated temperatures and/or vacuum.

Additionally, in some instances a precursor reaction may be performed to introduce desirable functional groups onto the surface of the particle to facilitate a reaction sequence in creating an ultra-thin coating. Examples of such functional groups include hydroxyl groups, amino groups, and metal-hydrogen bonds, which may serve as a site of further reaction to allow formation of an ultra-thin coating. Functionalization may be achieved through surface treatments including, for example, water plasma treatment, ozone treatment, ammonia treatment, and hydrogen treatment.

Oxide coatings can be prepared on particles having surface hydroxyl or amine (M-N—H) groups using a binary (AB) reaction sequence as follows. The asterisk (*) indicates the atom that resides at the surface of the particle or coating, and Z represents oxygen or nitrogen. $M^1$ is an atom of a metal (or semimetal such as silicon), particularly one having a valence of 3 or 4, and X is a displaceable nucleophilic group. The reactions shown below are not balanced, and are only intended to show the reactions at the surface of the particles (i.e., not inter- or intralayer reactions).

$$M\text{-}Z\text{-}H^* + M^1X_n \rightarrow M\text{-}Z\text{-}M^1X^* + HX \quad (A1)$$

$$M\text{-}Z\text{-}M^1X^* + H_2O \rightarrow M\text{-}Z\text{-}M^1OH^* + HX \quad (B1)$$

In reaction A1, reagent $M^1X_n$ reacts with one or more M-Z-H groups on the surface of the particle to create a "new" surface group having the form $-M^1X$. $M^1$ is bonded to the particle through one or more Z atoms. The $-M^1X$ group represents a site that can react with water in reaction B1 to regenerate one or more hydroxyl groups. The groups formed in reaction B1 can serve as functional groups through which reactions A1 and B1 can be repeated, each time adding a new layer of $M^1$ atoms. Atomic layer controlled growth and additional binary reactions are described in more detail in U.S. Pat. No. 6,613,383, which is herein incorporated by reference in its entirety.

Figure 4:
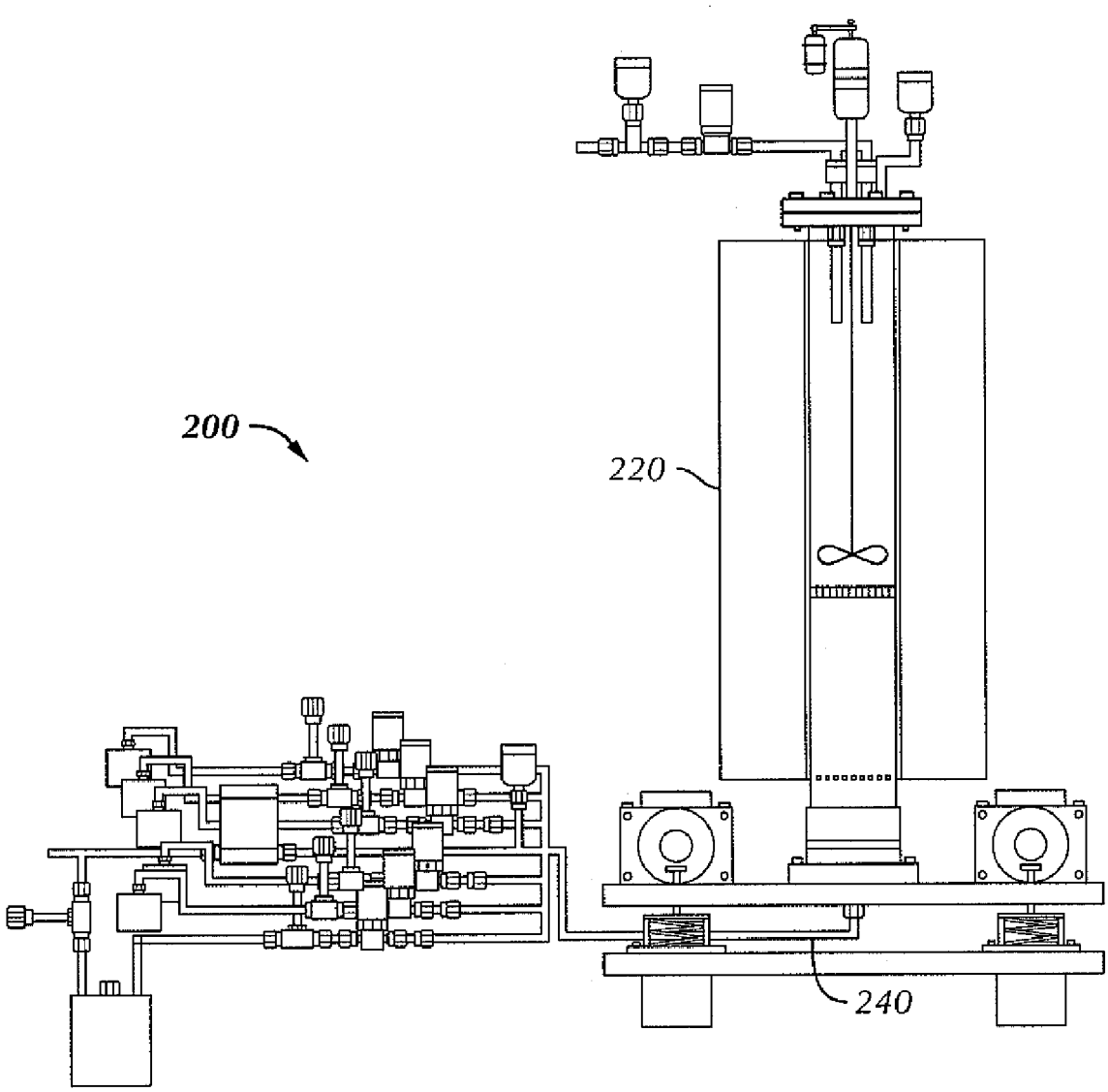
FIG. 4 shows a fluidized bed reactor that may be used in accordance with one embodiment of the present disclosure.

A convenient method for applying the ultra-thin, conformal coating to particulate material is to form a fluidized bed of the particles, and then pass the various reagents in turn through the fluidized bed under reaction conditions. Methods of fluidizing particulate material are well known and are described, for example, "Nanocoating Individual Cohesitve Boron Nitride Particles in a Fluidized Bed Reactor," Jeffrey R. Wank, et al., Powder Technology 142 (2004) 59-69. Briefly, the ALD process using a fluidized bed reactor, illustrated in FIG. 4, is described. Uncoated particles may be supported on a porous plate or screen 220 within a fluidized bed reactor 200. A fluidizing gas (such as $N_2$) may be passed into the reactor 200 through line 240 and upwardly through the plate or screen 220, lifting the particles and creating a fluidized bed. Fluid (gaseous or liquid) reagents may be introduced into the bed 200 also through line 240 for reaction with the surface of the particles. The fluidizing gas may also act as an inert purge gas following each dosing of the particles with reagent for removing unreacted reagents and volatile or gaseous reaction products.

If desired, multiple layers of ultra-thin coatings may be deposited on the abrasive particles. Where multiple layers of coating are desired, the multiple layers may possess an identity of composition, or the multiple layers may vary in composition. It is specifically within the scope of the present disclosure that the multiple layers may include combinations of any of the above described coating compositions such, for example, metal-on-metal, metal-on-oxide, and oxide-on-oxide. One of ordinary skill in the art would recognize that depending on the compositions of the applied coating, during any subsequent sintering conditions, the coating may undergo a number of transitions. For example, an ALD bi-layer of $Al_2O_3/TiO_2$, after sintering, may react and form an aluminum titanate coating. Further one of ordinary skill in the art would recognize that there is no limitation on the combination or number of layers which may be provided on the particulate material of the present disclosure.

Figure 5:
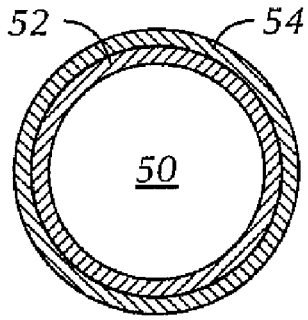
FIG. 5 shows an abrasive particle in accordance with the present disclosure.

Referring to FIG. 5, one embodiment of an abrasive particle having multiple layers in accordance with the present disclosure is shown. As shown, the abrasive particles 50 may be provided with a first, ceramic layer 52, such as those discussed above, coating the abrasive particles, on which an outer metal layer 54, also such as those discussed above, may be provided. In a particular embodiment, the inner layer 52 may be a metallic oxide, such as silica, alumina, zirconia, etc., while the outer layer 54 may be a metallic layer, such as nickel, cobalt, iron, etc.

Alternatively, a coating may be applied using atomic layer deposition methods as described above, and the coating may subjected to one or more reactions to form a modified coating. This technique may be used, for example, for creating ultra-thin coatings of various types that are not amenable to deposition using atomic layer deposition techniques. For example, various types of ultra-thin oxide coatings can be formed using the atomic layer deposition techniques described above, and then can be carburized to convert the oxide to the corresponding carbide.

The coatings disclosed herein may, in various embodiments, be either amorphous or crystalline in nature. Further, if a coating is amorphous in nature and is desirably crystalline, the particle having the coating thereon may be placed in a furnace at the appropriate environment for crystallization of the coating. In a particular embodiment, crystallization may occur in air at temperature of at least 600° C.

Once the abrasive particles are coated with an ultra-thin coating as described above, they may be used to form a hardfacing layer on a portion of a drill bit or other cutting tool. Abrasive particles that may be provided with an ultra-thin, conformal coating thereon include various materials used to form hardfacings having application in the cutting tool industry. In one embodiment, the abrasive particles may include tungsten carbide particles and diamond particles. In other various embodiments, the hard phase materials may include metal carbides, such as tungsten carbides, natural diamond, synthetic diamond, cubic boron nitride, and the like. Among the types of tungsten carbide particles that may be used to form sintered bodies of the present disclosure include cast tungsten carbide, macro-crystalline tungsten carbide, carburized tungsten carbide, and cemented tungsten carbide.

Suitable particle sizes for the abrasive particles of the present disclosure may range up to 1000 microns in one embodiment, and from the nanometer range (e.g., about 0.001 microns) to about 500 microns in another embodiment, and from about 10 to 250 microns in yet another embodiment. However, one of ordinary skill in the art would recognize that the ultra-thin, conformal coatings disclosed herein may also be provided on particles having a larger particle size. Particle size can also be expressed in terms of the surface area of the particles. In a particular embodiment, the abrasive particles may have a particle size ranging from 10 to $10^6$ times the thickness of the coating deposited thereon. In one embodiment, the particulate materials of the present disclosure have surface areas ranging from about 0.1 to 200 $m^2/g$ or more.

As discussed above, one type of tungsten carbide is macrocrystalline carbide. This material is essentially stoichiometric WC in the form of single crystals. Most of the macrocrystalline tungsten carbide is in the form of single crystals, but some bicrystals of WC may form in larger particles. The manufacture of macrocrystalline tungsten carbide is disclosed, for example, in U.S. Pat. Nos. 3,379,503 and 4,834,963, which are herein incorporated by reference.

U.S. Pat. No. 6,287,360, which is assigned to the assignee of the present invention and is herein incorporated by reference, discusses the manufacture of carburized tungsten carbide. Carburized tungsten carbide, as known in the art, is a product of the solid-state diffusion of carbon into tungsten metal at high temperatures in a protective atmosphere. Carburized tungsten carbide grains are typically multi-crystalline, i.e., they are composed of WC agglomerates. The agglomerates form grains that are larger than individual WC crystals. These larger grains make it possible for a metal infiltrant or an infiltration binder to infiltrate a powder of such large grains. On the other hand, fine grain powders, e.g., grains less than 5 microns, do not infiltrate satisfactorily. Typical carburized tungsten carbide contains a minimum of 99.8% by weight of carbon infiltrated WC, with a total carbon content in the range of about 6.08% to about 6.18% by weight. Tungsten carbide grains designated as WC MAS 2000 and 3000-5000, commercially available from H.C. Stark, are carburized tungsten carbides suitable for use in the formation of the matrix bit body disclosed herein. The MAS 2000 and 3000-5000 carbides have an average size of 20 and 30-50 micrometers, respectively, and are coarse grain conglomerates formed as a result of the extreme high temperatures used during the carburization process.

Another form of tungsten carbide is cemented tungsten carbide (also known as sintered tungsten carbide), which is a material formed by mixing particles of tungsten carbide, typically monotungsten carbide, and cobalt particles, and sintering the mixture. Methods of manufacturing cemented tungsten carbide are disclosed, for example, in U.S. Pat. Nos. 5,541,006 and 6,908,688, which are herein incorporated by reference. Sintered tungsten carbide is commercially available in two basic forms: crushed and spherical (or pelletized). Crushed sintered tungsten carbide is produced by crushing sintered components into finer particles, resulting in more irregular and angular shapes, whereas pelletized sintered tungsten carbide is generally rounded or spherical in shape.

Briefly, in a typical process for making cemented tungsten carbide, a tungsten carbide powder having a predetermined size (or within a selected size range) is mixed with a suitable quantity of cobalt, nickel, or other suitable binder. The mixture is typically prepared for sintering by either of two techniques: it may be pressed into solid bodies often referred to as green compacts, or alternatively, the mixture may be formed into granules or pellets such as by pressing through a screen, or tumbling and then screened to obtain more or less uniform pellet size. Such green compacts or pellets are then heated in a controlled atmosphere furnace to a temperature near the melting point of cobalt (or the like) to cause the tungsten carbide particles to be bonded together by the metallic phase. Sintering globules of tungsten carbide specifically yields spherical sintered tungsten carbide. Crushed cemented tungsten carbide may further be formed from the compact bodies or by crushing sintered pellets or by forming irregular shaped solid bodies.

The particle size and quality of the sintered tungsten carbide can be tailored by varying the initial particle size of tungsten carbide and cobalt, controlling the pellet size, adjusting the sintering time and temperature, and/or repeated crushing larger cemented carbides into smaller pieces until a desired size is obtained. In one embodiment, tungsten carbide particles (unsintered) having an average particle size of between about 0.2 to about 20 microns are sintered with cobalt to form either spherical or crushed cemented tungsten carbide. In a preferred embodiment, the cemented tungsten carbide is formed from tungsten carbide particles having an average particle size of about 0.8 to about 5 microns. In some embodiments, the amount of cobalt present in the cemented tungsten carbide is such that the cemented carbide is comprised of from about 6 to 8 weight percent cobalt.

Cast tungsten carbide is another form of tungsten carbide and has approximately the eutectic composition between bitungsten carbide, $W_2C$, and monotungsten carbide, WC. Cast carbide is typically made by resistance heating tungsten in contact with carbon, and is available in two forms: crushed cast tungsten carbide and spherical cast tungsten carbide. Processes for producing spherical cast carbide particles are described in U.S. Pat. Nos. 4,723,996 and 5,089,182, which are herein incorporated by reference. Briefly, tungsten may be heated in a graphite crucible having a hole through which a resultant eutectic mixture of $W_2C$ and WC may drip. This liquid may be quenched in a bath of oil and may be subsequently comminuted or crushed to a desired particle size to form what is referred to as crushed cast tungsten carbide. Alternatively, a mixture of tungsten and carbon is heated above its melting point into a constantly flowing stream which is poured onto a rotating cooling surface, typically a water-cooled casting cone, pipe, or concave turntable. The molten stream is rapidly cooled on the rotating surface and forms spherical particles of eutectic tungsten carbide, which are referred to as spherical cast tungsten carbide.

The standard eutectic mixture of WC and $W_2C$ is typically about 4.5 weight percent carbon. Cast tungsten carbide commercially used as a matrix powder typically has a hypoeutectic carbon content of about 4 weight percent. In one embodiment of the present invention, the cast tungsten carbide used in the mixture of tungsten carbides is comprised of from about 3.7 to about 4.2 weight percent carbon.

The various tungsten carbides disclosed herein may be selected so as to provide a bit that is tailored for a particular drilling application. For example, the type, shape, and/or size of carbide particles used may affect the material properties of the resulting hardfacing layer, including, for example, fracture toughness, and wear and erosion resistance.

Carbide particles are often measured in a range of mesh sizes, for example 40 to 80 mesh. The term "mesh" actually refers to the size of the wire mesh used to screen the carbide particles. For example, "40 mesh" indicates a wire mesh screen with forty holes per linear inch, where the holes are defined by the crisscrossing strands of wire in the mesh. The hole size is determined by the number of meshes per inch and the wire size. The mesh sizes referred to herein are U.S. Standard Sieve Series mesh sizes, also described as ASTM E11. A standard 40 mesh screen has holes such that only particles having a dimension less than 420 μm can pass. That is, particles larger than 420 μm in size will be retained on a 40 mesh screen, while particles smaller than 420 μm will pass through the screen.

Therefore, the range of sizes of the carbide particles in a filler is defined by the largest and smallest grade of mesh used to screen the particles. An exemplary filler comprising carbide particles in the range of from 16 to 40 mesh will only contain particles larger than 420 μm and smaller than 1190 μm, whereas another filler comprising particles in the range of from 40 to 80 mesh will only contain particles larger than 180 μm and smaller than 420 μm. Hence, there is no overlap in terms of particle size between these two ranges.

In various embodiments, the abrasive particles may range in size from 16 to 325 mesh. In particular, some embodiments of the present disclosure may include one or more of the following types and sizes of carbides: sintered carbide, in the form of crushed or spherical particles, having a size in the range of about 16-30 ASTM mesh, 30 to 40 ASTM mesh, and/or 100 to 325 ASTM mesh; crushed cast carbide having a particle size in a range of about 40-80 ASTM mesh; and macro-crystalline tungsten carbide having a particle size in a range of less than about 80 ASTM mesh, or about 100-200 ASTM mesh. In particular embodiments, it may be desirable to use small hard particles to fit in the gaps between the larger, 16 to 40 mesh particles. However, one of ordinary skill in the art would appreciate that, conventionally, these smaller particles of 100 to 325 mesh are more prone to damage due to the high imposed temperature during welding.

In this embodiment, therefore, an ultra-thin diffusion barrier may be applied having a selected thickness. The diffusion barrier may reduce or prevent the transfer of metal (often occurring during the hardfacing application process) to and from the hardfacing granules. In addition to reducing or preventing metal diffusion, by providing a barrier coating in this manner, embodiments of the present disclosure may prevent or reduce the formation of a "halo" as described in reference to the '779 patent above. Further, by providing the barrier coating, the nominal particle size of the abrasive particles (e.g., 16 to 40 mesh, etc.) may be maintained. Without such a barrier coating, metal diffusion results in a decrease in diameter of the abrasive particles, which causes a reduced wear resistance and toughness.

Figure 6:
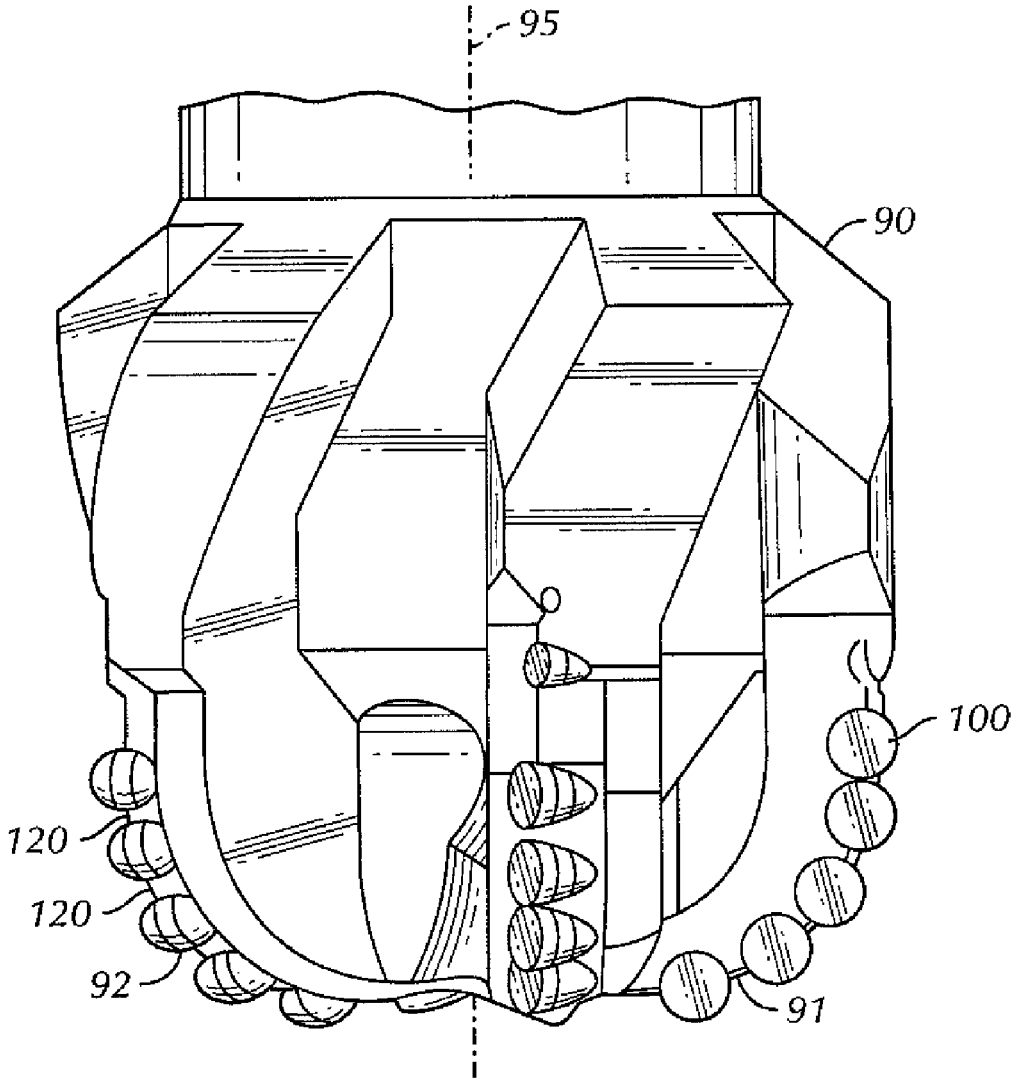
FIG. 6 shows a fixed cutter bit in accordance with the present disclosure.

Further, as stated above, embodiments of the present disclosure apply equally well to fixed cutter bits as to roller cone bits. For example, FIG. 6 shows a steel drill bit body 90 comprising at least one PDC cutter 100. The steel drill bit body 90 is formed with at least one blade 91, which extends radially from a central longitudinal axis 95 of the drill bit 90.

In the present embodiment, the steel drill bit body 90 includes a hardfacing layer 120, which includes an abrasive phase formed from abrasive particles having a barrier coating deposited by atomic layer deposition disposed thereon, and a binder alloy. As with the above, the hardfacing layer 120 may be applied using any technique known in the art, such as "tube," thermal spray, or arc hardfacing. The PDC cutter 100 is disposed on the blade 91. The number of blades 91 and/or cutters 100 is related, among other factors, to the type of formation to be drilled, and can thus be varied to meet particular drilling requirements.

The PDC cutter 100 may be formed from a sintered tungsten carbide composite substrate (not shown separately in FIG. 7) and a polycrystalline diamond compact (not shown separately in FIG. 7), among other materials. The polycrystalline diamond compact and the sintered tungsten carbide substrate may be bonded together using any method known in the art.

After being provided with the diffusion barrier coating described above, the coated particles may be applied as a hardfacing layer to the teeth and/or shirttail using processes well known in the art. One such process is atomic hydrogen welding. Another process is oxyacetylene welding. Other processes include plasma transferred arc ("PTA"), gas tungsten arc, shield metal arc processes, laser cladding, and other thermal deposition processes. In oxyacetylene welding, for example, the hardfacing material is typically supplied in the form of a tube or hollow rod ("a welding tube"), which is filled with coated particles having a selected composition. The tube is usually made of steel (iron) or similar metal (e.g., nickel and cobalt) which can act as a binder when the rod and its granular contents are heated.

The tube thickness is selected so that its metal forms a selected fraction of the total composition of the hardfacing material as applied to the drill bit. The granular filler of the rod or tube typically includes various forms of metal carbides (e.g., tungsten, molybdenum, tantalum, niobium, chromium, and vanadium carbides), and most typically, various forms of tungsten carbide. Alternatively, the binder alloy may be in the form of a wire ("a welding wire") and the hardfacing materials are coated on the wire using resin binders. With a PTA welding process, the hardfacing materials may be supplied in the form of a welding tube, a welding wire, or powder, although the powder form is preferred.

Other methods and techniques for applying hardfacing materials are known in the art and are omitted here for the sake of clarity. It should be noted that while oxyacetylene welding may be a preferred method of applying the improved hardfacing composition (including the coated particles) disclosed herein, any suitable method may be employed.

Advantageously, embodiments of the present disclosure for coated particles that have a diffusion barrier to prevent or reduce the transfer of metal to and from the granules. Therefore, embodiments of the present disclosure may advantageously provide coated particles that maintain their diameters after welding by reducing the dissolution of the abrasive into the surrounding matrix. Further, it has been discovered that larger diameter granules may improve the life and rate of penetration for drill bits.

Embodiments of the present disclosure may also provide a hardfacing composition having an improved toughness. However, not only may the composition have improved toughness and impact properties, but without sacrificing wear resistance. Advantageously, compositions of the present invention make the tube rod (used during the application of a hardfacing layer) easier to weld, and help ensure that the weld quality is less dependant on the skill level of the welder.

Further, by providing multiple layers on abrasive particles, a first ceramic layer may be selected so as to provide thermal insulation to the abrasive particle, especially during the high temperatures experienced during welding that have conventionally affected performance of the hardfacing. Thus, the thermal insulation may protect the abrasives against formation of a brittle eta-phase which are typically formed during the high welding temperatures. Additionally, a second metal layer may be provided for weldability and adhesion to the surrounding matrix. By providing an ultra-thin coating via atomic layer deposition, the metal content from the coating is minimized so as to minimally affect wear resistance.

In addition, while reference has been made to tungsten carbide and cobalt containing materials, other transition metal carbides, transition metal nitrides, and other suitable superhard materials are specifically within the scope of the present invention. That is, the coating techniques described above, may be used with materials other than the tungsten carbide compositions disclosed above.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed:

1. A roller cone drill bit for drilling earth formations, comprising:
- a bit body;
- at least one roller cone rotatably mounted to the bit body; and
- at least one cutting element on the at least one roller cone, wherein a hardfacing layer is disposed on an exterior surface of the at least one cutting element, the hardfacing layer comprising:
  - an abrasive phase comprising:
    - a plurality of abrasive particles having a barrier coating deposited by atomic layer deposition disposed thereon;
    - wherein the abrasive particles comprise cemented tungsten carbide particles;
    - wherein the barrier coating comprises a layer of ceramic material disposed on the abrasive particles; and
    - wherein the barrier coating comprises a thickness ranging from about 1 to 500 nanometers; and
  - a binder alloy.

2. The hardfacing composition of claim 1, wherein the barrier coating comprises a thickness of less than about 100 nanometers.

3. The hardfacing composition of claim 1, wherein the abrasive particles comprise particles having a size in a range of about 16 to 325 mesh.

4. The hardfacing composition of claim 1, wherein the abrasive particles comprise sintered tungsten carbide particles having a size in a range of about 16 to 40 mesh.

5. The hardfacing composition of claim 1, wherein the abrasive particles comprise sintered tungsten carbide particles having a size in a range of about 100 to 325 mesh sintered tungsten carbide particles for gage row teeth or to fill the gaps between the larger particles.

6. The hardfacing composition of claim 1, wherein the binder alloy is in a form selected from a welding tube, a welding wire, and powder.

7. The drill bit of claim 1, wherein the barrier coating further comprises a metallic layer disposed on the ceramic layer.

8. The hardfacing composition of claim 7, wherein the metallic layer comprises at least one of cobalt, nickel, and iron, or alloys thereof.

9. The drill bit of claim 1, wherein the ceramic layer comprises a metal oxide.

10. The hardfacing composition of claim 9, wherein the metal oxide comprises at least one of alumina, zirconia, and silica.

11. A drill bit for drilling earth formations comprising:
- a bit body having at least one blade thereon;
- at least one cutter pocket disposed on the blade;
- at least one cutter disposed in the cutter pocket; and
- a hardfacing layer applied to at least a select portion of the drill bit body, the hardfacing comprising:
  - an abrasive phase comprising:
    - a plurality of abrasive particles having a barrier coating deposited by atomic layer deposition disposed thereon;
    - wherein the abrasive particles comprise cemented tungsten carbide particles;
    - wherein the barrier coating comprises a layer of ceramic material disposed on the abrasive particles; and
    - wherein the barrier coating comprises a thickness ranging from about 1 to 500 nanometers; and
  - a binder alloy.

12. The drill bit of claim 11, wherein the barrier coating further comprises a metallic layer disposed on the ceramic layer.

13. The drill bit of claim 11, wherein the ceramic layer comprises a metal oxide.

* * * * *